US006045114A

United States Patent [19]

Nogami

[11] Patent Number: 6,045,114

[45] Date of Patent: Apr. 4, 2000

[54] ELONGATED, CURVED FRAMEWORK WITH A VARIABLE DEGREE OF CURVATURE

[76] Inventor: Shinichi Nogami, 3-5, Fukanokita 1-chome, Daito-shi, Osaka, Japan

[21] Appl. No.: 08/856,232

[22] Filed: May 14, 1997

[30] Foreign Application Priority Data

May 15, 1996 [JP] Japan ..... 8-120597
Aug. 5, 1996 [JP] Japan ..... 8-205801

[51] Int. Cl.[7] ..... E04G 17/14

[52] U.S. Cl. ..... 249/209; 249/11; 249/212

[58] Field of Search ..... 52/108; 249/11, 249/12, 209, 212, 194

[56] References Cited

U.S. PATENT DOCUMENTS

| | | | |
|---|---|---|---|
| 1,019,314 | 3/1912 | Frick | 249/209 |
| 1,112,542 | 10/1914 | Loser | 249/209 |
| 1,284,766 | 11/1918 | Popendick | 249/209 |
| 1,314,040 | 8/1919 | Bely et al. | 249/11 |
| 1,734,773 | 11/1929 | Murray | 249/11 |
| 4,745,714 | 5/1988 | Matsutani | 52/108 |

FOREIGN PATENT DOCUMENTS

| | | |
|---|---|---|
| 0 218808 | 4/1987 | European Pat. Off. . |
| 831263 | 8/1938 | France . |

*Primary Examiner*—Michael Safavi
*Attorney, Agent, or Firm*—Lowe Hauptman Gopstein Gilman & Berner

[57] ABSTRACT

An elongated, curved framework with a variable degree of curvature. The framework comprises plural link members, joint units connecting the link members together, and elements for bending the link members at the joints. A desired number of link members can be connected together to provide a desired length of elongated, curved framework. Inside the joint unit is located a bolt-engaging member, and the joint unit and the bolt-engaging member are joined together by a bolt. The bolt is engaged with a nut. Rotating the bolt in one direction causes the link members to bend at the joint in one direction. Rotating the bolt in an opposed direction causes the link members to bend at the joint in an opposed direction. Three pins can be used to enable the link members to withstand load well.

2 Claims, 7 Drawing Sheets

ELONGATED, CURVED FRAMEWORK WITH A VARIABLE DEGREE OF CURVATURE

FIELD OF THE INVENTION

This invention relates to an elongated, curved framework with a variable degree of curvature, especially useful for concrete work.

BACKGROUND OF THE INVENTION

Mixed concrete must be placed into a form. A form also often is called a formwork or shuttering. FIG. 17 shows concrete A placed into a formwork 30. The formwork 30 has a curved section 31. This section 31 is supported directly by a first support structure 33 that includes support materials 32 and curved support portions. The first support structure 33 is in turn supported by square steel bars 34 that are arranged perpendicular to the first support structure 33. Then, a support block 35 is used as an outermost support structure. The support block 35 is fixed to the formwork 30 by means of bolts 36 each having at one end a form tie 37 into which a wedge 38 is driven.

FIG. 18 also shows prior art. In FIG. 18, a curved metal pipe 39 is employed instead of the support block 35 of FIG. 17. As illustrated, the metal pipe 39 is fixed to the form 31 similarly to the support block 35.

Thus, FIGS. 17 and 18 depict two different techniques 35 and 39 for supporting a curved section of a formwork.

With the first technique of FIG. 17, however, it is costly and time-consuming to prepare many support blocks that each must have a curved surface similar to a particular curved portion of a formwork to be supported. Also, a support block with a particular degree of curvature cannot be used to support a curved portion of a formwork which has a different degree of curvature from the support block. Also, the support block is rather bulky and therefore takes up a lot of space when it is stored.

With the second technique of FIG. 18, it takes much time and trouble to curve plural metal pipes to particular degrees of curvature in the building site. Also, it is not easy to vary the curvature of a metal pipe already curved to some degree of curvature. In addition, a metal pipe is relatively bulky and therefore occupies no small space when it is stored.

SUMMARY OF THE INVENTION

Accordingly, it is an object of the invention to provide an effective alternative to the support block 35 of FIG. 17 or the metal pipe 39 of FIG. 18, which is free from the foregoing drawbacks of those conventional support structures.

Another object of the invention is to provide an elongated, curved framework, especially suited to support a curved portion of a formwork.

Other objects and advantages of the invention will become apparent from the detailed description of the invention that will follow.

DETAILED DESCRIPTION OF PREFERRED EMBODIMENT

Figure 1:
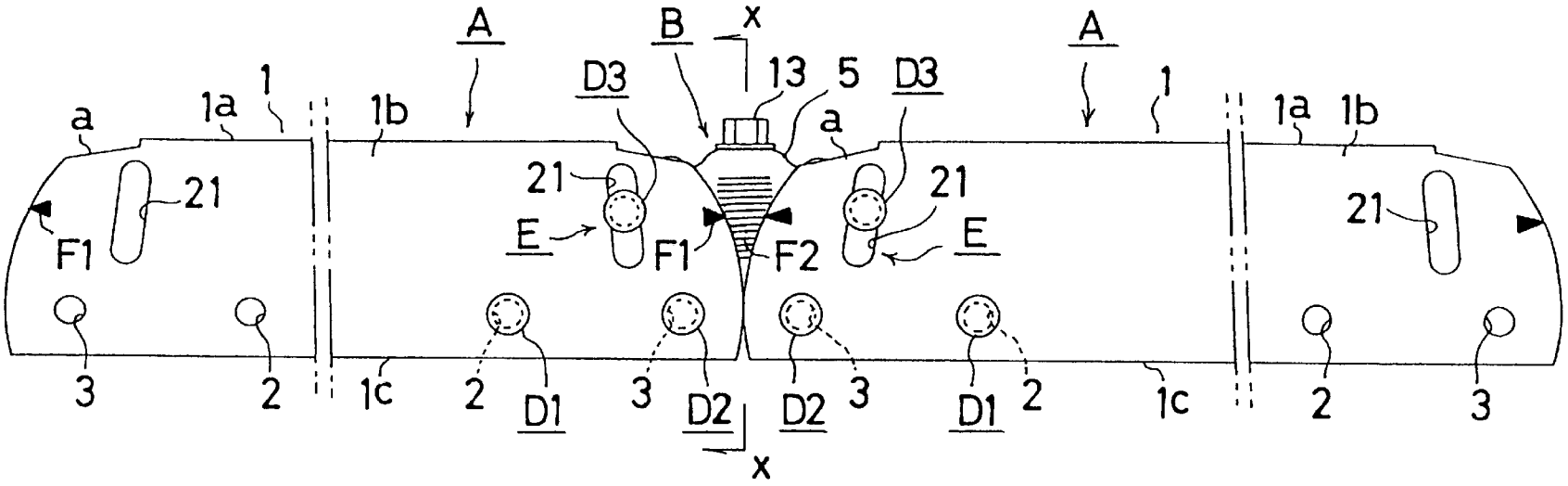
FIG. 1 may be considered to show part of an elongated framework constructed according to the invention, as this Figure illustrates two link members A, A connected together by a joint unit B.

Referring to the drawings, the invention will now be described in greater detail. An elongated framework according to the invention comprises (1) plural link members A, (2) joint units B connecting the link members together, and (3) elements for bending the link members A at the joints.

Figure 2:
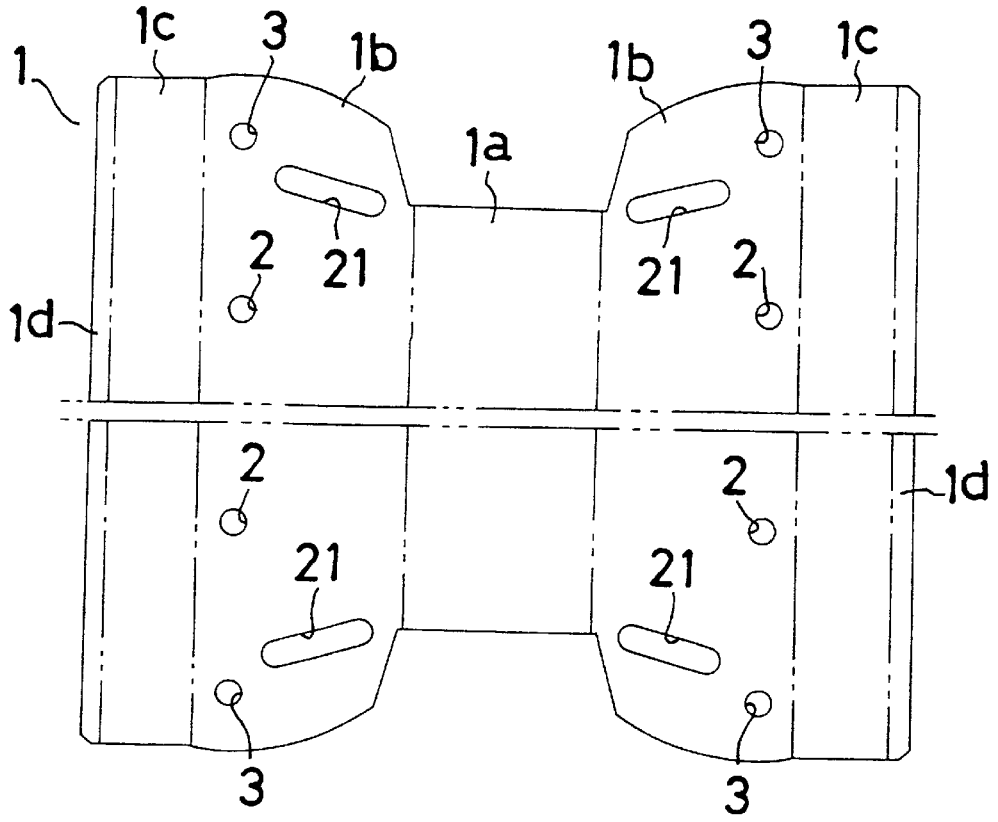
FIG. 2 is a flat metal plate 1 that can be bent into the link member A. In this Figure, however, the flat plate 1 is shown as substantially reduced in its length.

The link member A is a hollow, square bar formed by bending a flat metal plate 1 of FIG. 2. In FIG. 2, however, the plate 1 is shown as reduced very much in its length for the sake of convenience. The flat plate 1 is bent such that its section designated by the reference numeral 1*a* forms a top (of the link member), its sections 1*b*, 1*b* form opposed sides, and its sections 1*c*, 1*c* form a bottom together. Sections 1*d*, 1*d* are so bent as to touch each other, thereby forming a centerline (not shown) of the bottom of the link member. The sections 1*d*, 1*d* may be spot-welded if necessary, and serve as a rib that strengthens the link structure A.

Only two link members A, A are shown in FIG. 1, but a desired number of link members can be connected together to construct a desired length of elongated framework of the invention. As shown, the link members A, A are connected together by the joint unit B. Each link member A has a square shape in its vertical cross section, and each side in its vertical cross section may have a length of, for example, 5 centimeters, although each link member A of FIG. 1, like the flat plate 1 of FIG. 2, is illustrated as shortened considerably for convenience's sake. As shown in FIG. 1, each link member A is formed into a sloping shoulder a at each end thereof, so that the link members A, A can be bent at the joint. This feature of the shape of the link member also can be seen from FIG. 2. Also as shown in FIG. 1, each link member A is, at each end thereof, engraved with an arrow F1 that cooperates with plural parallel lines F2 engraved on the joint unit B, to indicate the angle of the link member with the joint unit B.

Figure 3:
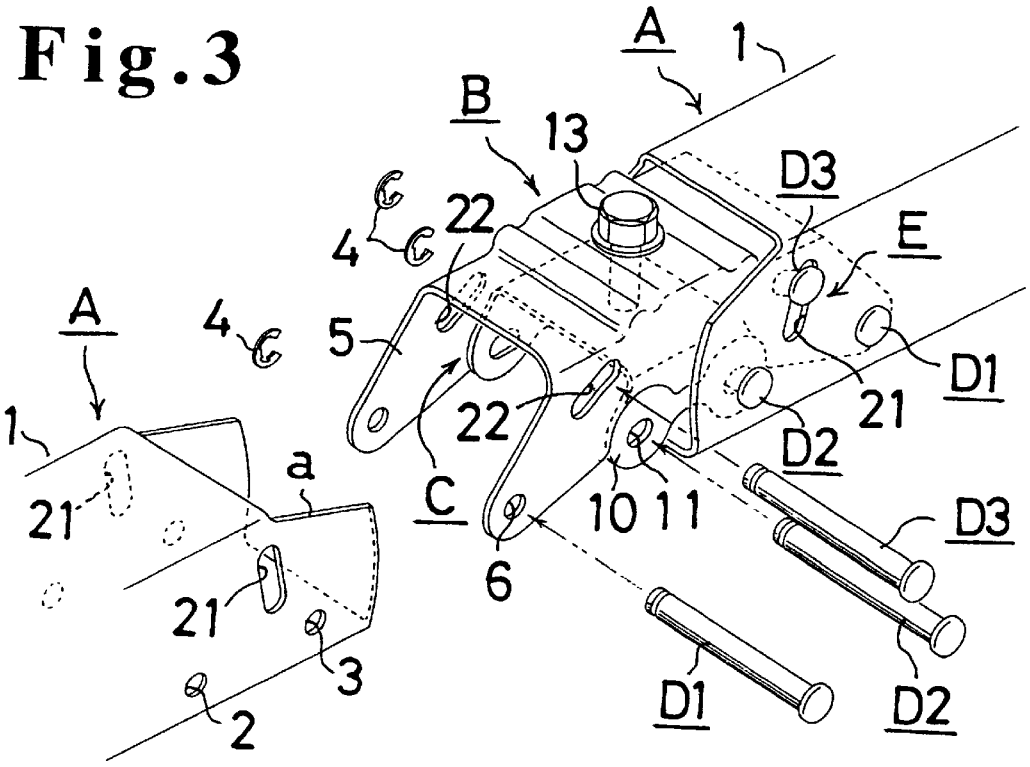
FIG. 3 illustrates how the two link members A, A can be connected together by the joint unit B.

Openings 2, 3, and 21 are formed at each end portion of the link member A. One opening 2 is formed in one side 1*b* of the link member, and another opening 2 is formed in the opposed side 1*b* thereof and is in alignment with the one opening 2. This is also the case with the openings 3 and 21. Only the upper opening 21 has an elongated shape. As shown in FIGS. 1 and 3, these openings 2, 3, and 21 receive pins D1, D2, and D3, respectively, that will be described hereafter.

Figure 4:
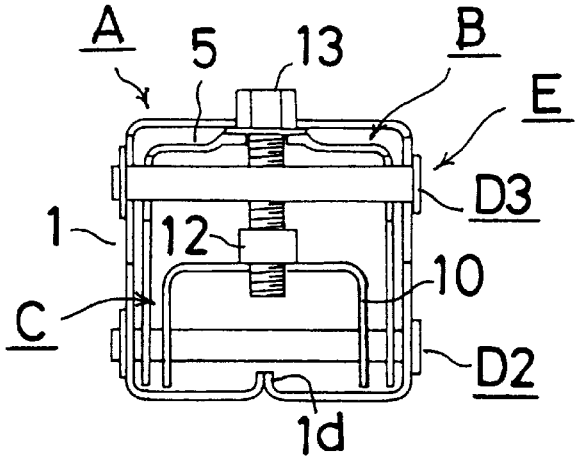
FIG. 4 is a vertical cross section of the construction of FIG. 1 taken on line X—X of FIG. 1.
Figure 5:
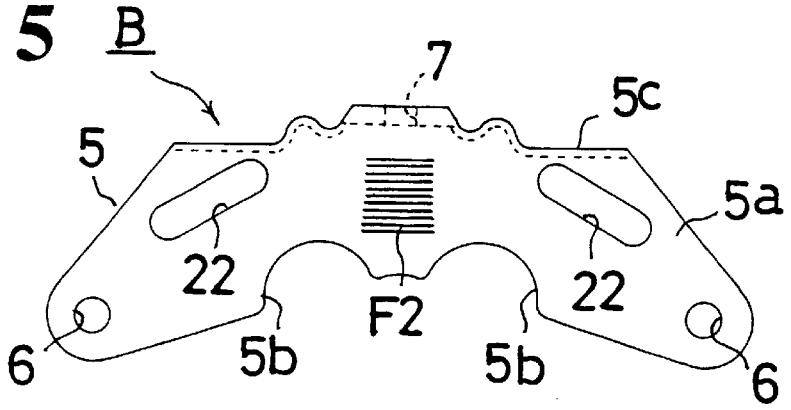
FIG. 5 is a front view of the joint unit B.
Figure 6:
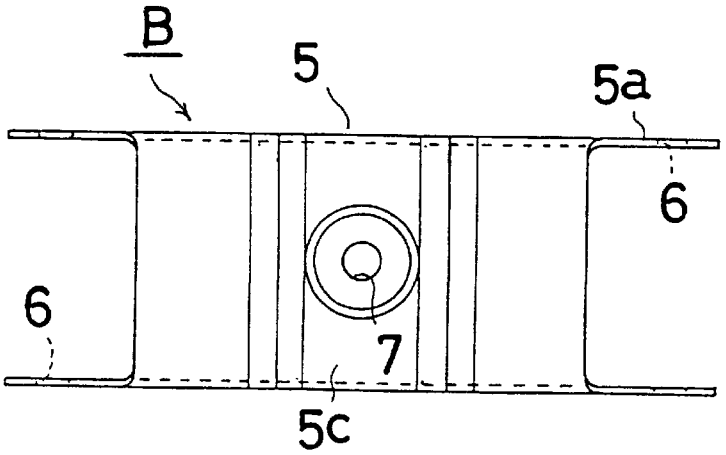
FIG. 6 is a plan view of the joint unit B.
Figure 12:
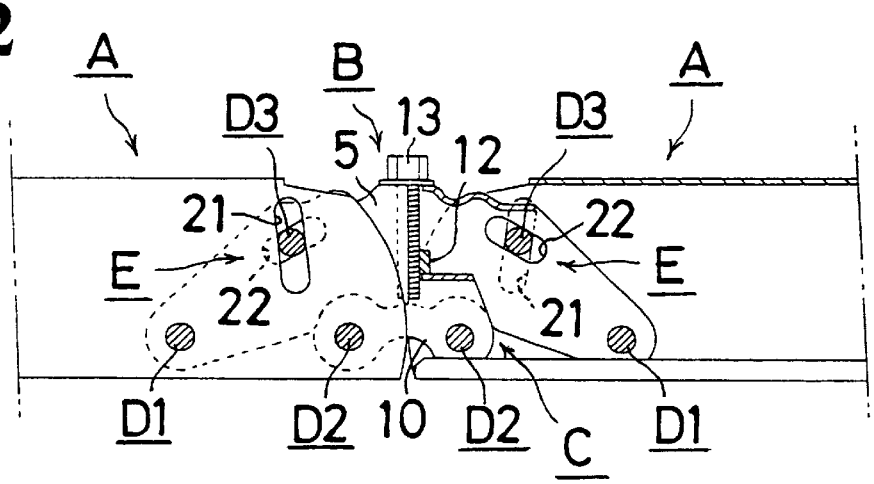
In FIG. 12 the link members A, A are not bent but are aligned with each other.

The joint unit B is best shown in FIGS. 3 and 5. FIG. 5 is a front view of the joint unit B. As shown, the joint unit B generally has the shape of a trapezoid, and as clearly shown in FIG. 4, the joint unit B has an inverted-U shape in its vertical cross section. The joint unit B has a pair of opposed openings 6, 6 at its each end portion (FIGS. 5 and 6). These openings 6, 6 receive the pin D1 together with the openings 2 of the link member A. The joint unit B also has a pair of opposed elongated openings 22, 22 at its each side. These elongated openings 22, 22 receive the pin D3 along with the elongated openings 21 of the link member A. The elongated opening 22 of the joint unit is located inside the elongated opening 21 of the link member A in a position corresponding to the latter 21, and is oriented relative to the outer elongated opening 21 such that, when the link members A, A are in alignment with each other, the two openings 22 and 21 extend not in the same direction but in different directions that make an angle of some 45 degrees with each other (FIG. 12). As clearly illustrated in FIG. 5, the joint unit B is so cut away at its lower portion as to form semicircular edges 5*b*, 5*b* whereby the link member can make a pivotal motion on the pin D1 without being interfered with by the pin D2. Also, an opening 7 is formed in the top 7 of the joint unit B. A bolt 13 is inserted through the opening 7.

The pin D1, inserted through the openings 2 of the link member A and the openings 6 of the joint unit B, connects the link member and the joint unit B together. The pin D3, inserted through the upper, elongated openings 21 and 22, also perform a similar function to the connecting pin D1, but the pin D3 and elongated openings 21 and 22 may be entirely omitted. The connecting pin D1 is sufficient to connect the link member and joint unit together. The elongated framework of the invention, therefore, can be constructed without the pin D3 and its associated openings 21 and 22. In the illustrated embodiment, however, the pin D3 is provided for its function that will be described hereafter.

Figure 7:
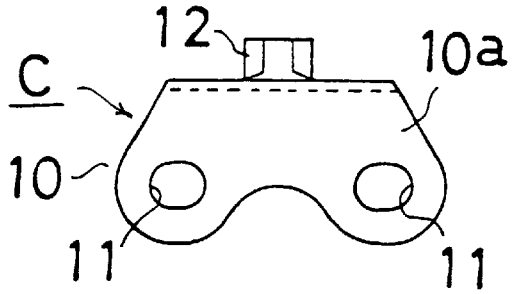
FIG. 7 is a front view of a bolt-engaging member C.
Figure 8:
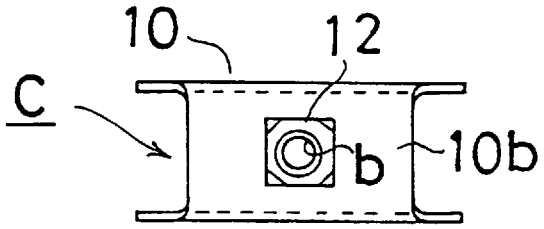
FIG. 8 is a plan view of the engaging member C.
Figure 9:
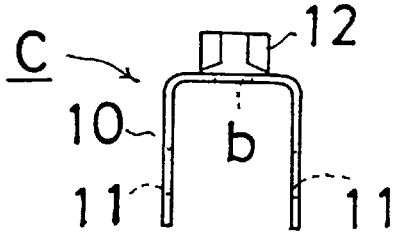
FIG. 9 is a side view of the engaging member C.
Figure 10:
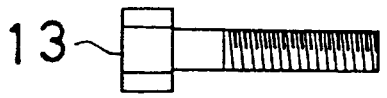
FIG. 10 shows a bolt 13 to be engaged with a nut 12 of the engaging member C.
Figure 11:
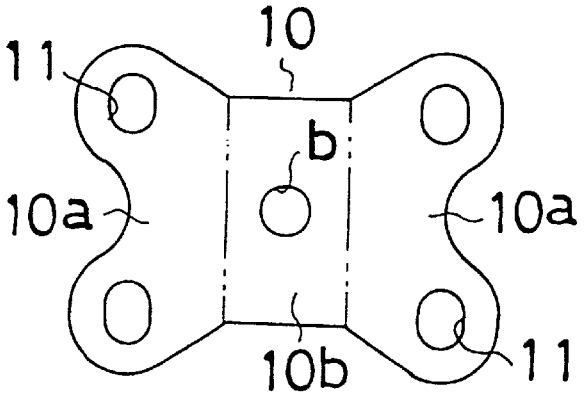
FIG. 11 shows a flat plate 10 that can be bent into an inverted U-shaped base which is part of the engaging member C.
Figure 13:
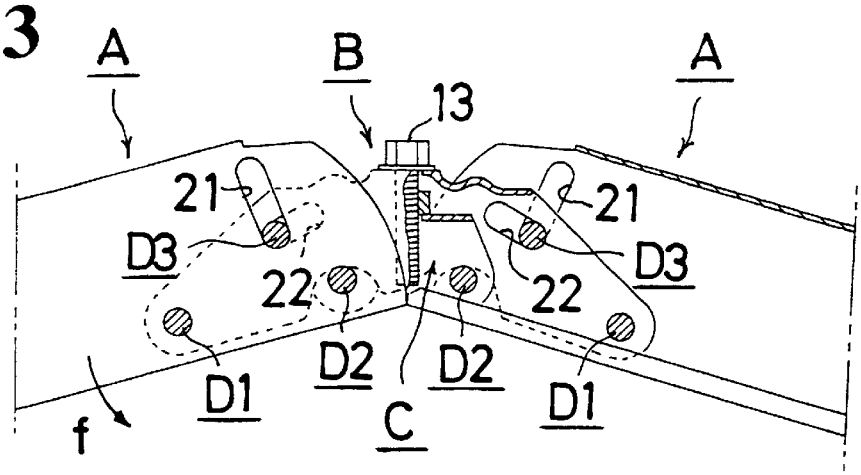
In FIG. 13 the link members A, A are bent at the joint in one direction.
Figure 14:
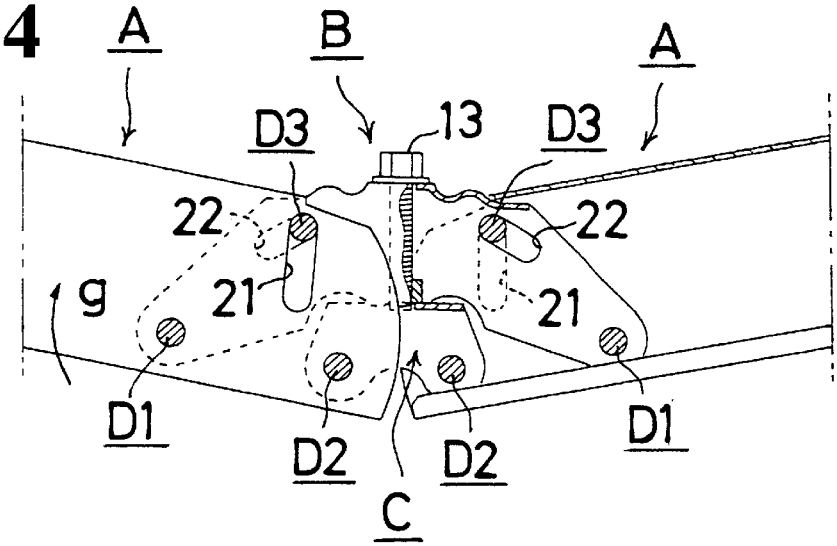
In FIG. 14 the link members A, A are bent at the joint in the opposite direction.

Inside the joint unit B is located a bolt-engaging member C (FIGS. 3 and 4). FIG. 7 is a front view of the engaging member C. As clearly shown in FIG. 9, this member C comprises an inverted-U shaped base and a nut 12 fixed to that base. This base is formed by bending a flat metal plate 10 of FIG. 11 such that its portion designated by reference numeral 10*b* forms a top (of the base) and its portions 10*a*, 10*a* form opposed sides. An opening b is formed in the top 10*b* of the base. A nut 12 is fixed to the top 10*b*, and surrounds the central opening b. Also, two openings 11, 11 are formed in each side 10*a* of the base. The pin D2 is inserted through the openings 3 of the link member A and the openings 11 of the engaging member C, and thus connects the two members A and C together. The engaging member C is located relative to the joint unit B such that the central opening b of the base of the engaging member C is aligned with the central opening 7 of the joint unit B. The bolt 13 is inserted through these openings 7 and b. The bolt 13 thus passes through and, is in engagement with, the nut 12 (FIG. 14). Rotating the bolt 13 in one direction makes the bolt 13 go deeper into the engaging member C, with the result that the joint unit B comes down relative to the engaging member C (FIG. 13). This causes each link member A to make a downward pivotal motion on the pins D1, D2, and D3 and, thus, the adjacent link members A, A are bent at the joint in one direction (f in FIG. 13).

Rotating the bolt 13 in the opposite direction, however, makes the bolt 13 rise higher from the engaging member C, with the result that the joint unit B goes up relative to the engaging member C (FIG. 14). This causes each link member A to make an upward pivotal motion on the pins D1, D2, and D3 and, thus, the adjacent link members A, A are bent at the joint in the opposite direction (q in FIG. 14).

Figure 17:
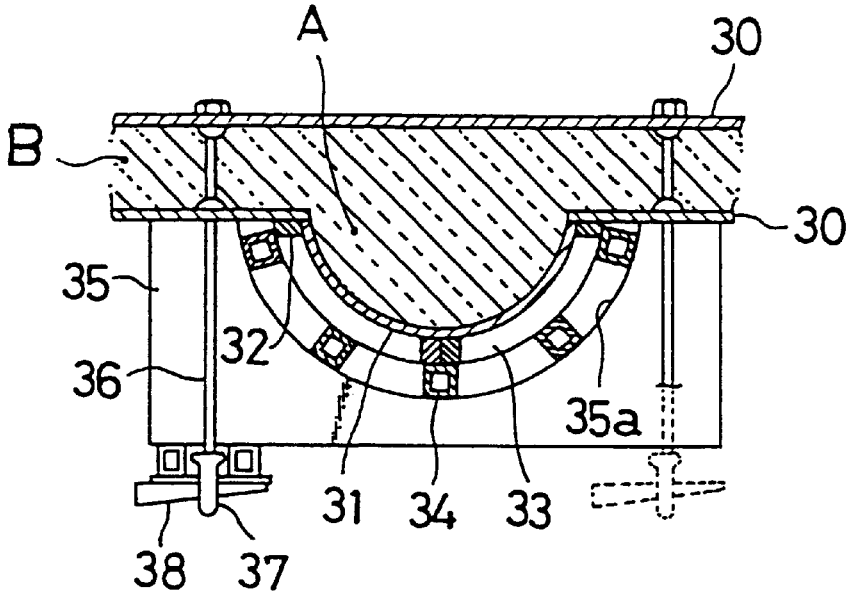
FIGS. 17 and 18 show prior art.

Thus, it will be appreciated that, according to the invention, an elongated framework having a desired length and curved to a desired degree can be provided by use of a desired number of link members A. Also, it can be appreciated from FIG. 15 what shape, for example, the elongated framework of the invention may take. Thus, it will be easily appreciated that one typical use of the elongated framework is as an effective alternative to the support block 35 of FIG. 17 or the support pipe 39 of FIG. 18 in concrete work.

Whichever direction (f in FIG. 13 or q in FIG. 14) the link members are bent in, the engagement between the bolt 13 and the nut 12, itself, fixes the link members at the angles to which they have been bent.

As illustrated in FIG. 3, a circular groove is formed in one end portion of each pin (D1, D2, and D3), and a C-shaped retaining piece 4 is engaged with the groove. This prevents the pin being removed from the link member. The retaining piece 4 can be removed.

To repeat, the elongated framework of the invention can be constructed even if the pin D3 is omitted. In certain uses, the elongated framework without the pin D3 does perform adequately. In the illustrated embodiment, however, the pin D3 is provided, for naturally three pins D1, D2, and D3 make it possible for the link member, which is making some angle with the joint unit in use, to withstand load better than two pins D1 and D2. Thus the pin D3 is particularly useful when the link members must bear a relatively large load that could result in further bending the link members and, hence, breaking the whole framework if it were not for the pin D3. A typical example of such a case is the use of the framework as an alternative to the support block 35 of FIG. 17 or the support pipe 39 of FIG. 18 in concrete work.

Special attention should be directed to the position in FIG. 13 of the reinforcing pin D3 in the elongated openings 21 and 22. That is, in FIG. 13, the two openings 21 and 22 overlap each other at one end thereof so that the two openings 21 and 22 generally form the shape of V, and the pin D3 is positioned in the one end of each opening (21 and 22) that meets the one end of the other opening. In this condition, the link members A, A are certainly prevented from being further bent in the direction f. Thus, FIG. 13 shows one extreme curved position of the link members A, A. Similarly, FIG. 14 shows another extreme curved position of the link members. The link members can be bent between the two extreme curved positions.

It will be appreciated that the bolt 13 and engaging member C may be considered to form an element for bending the link members A, A at the joint.

Figure 18:
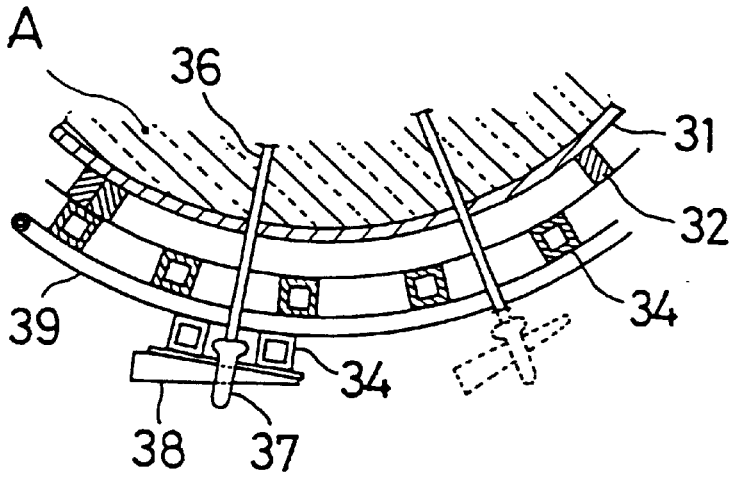

The elongated framework of the invention can be assembled, as follows, for use as an alternative to the support pipe 39 of FIG. 18. First, one link member A is fixed to the curved formwork 31 by use of bolts 36, form ties 37 and other necessary materials. Then, another link member A is joined with the first link member by use of a joint unit B (to which a bolt-engaging member C is beforehand connected with a bolt 13) and connecting pins D1 and D2. Then, for each link member A, a reinforcing pin D3 is inserted through the elongated openings 21 (of the link member) and 22 (of the joint unit). One retaining piece 4 is engaged with the circular groove of one end of each pin. Then, the bolt 13 is rotated for a necessary amount in a necessary direction to locate the link members in a necessary position bent at the joint. Then, a third link member is similarly connected to the first or second link member.

After the elongated framework has been used with a particular degree of curvature, its degree of curvature can be varied for a different use simply by rotating the bolt 13.

Figure 15:
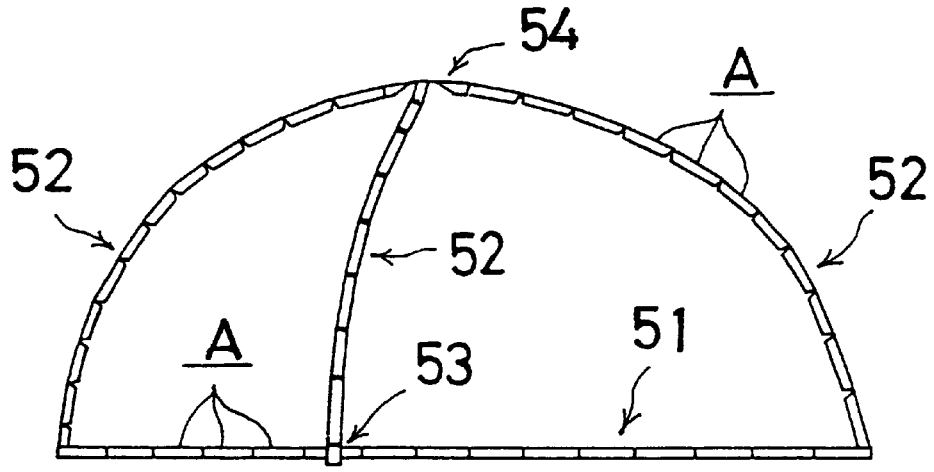
FIG. 15 shows a dome-shaped construction that can be constructed by use of elongated frameworks of the invention.

Elongated frameworks of the invention also can be used to construct a dome-shaped structure of FIG. 15. A circular base 51 can be constructed by using one or more elongated frameworks. A round roof can be constructed with plural elongated frameworks 52, which can be connected together at their tops by use of connecting means 54 and connected to the base 51 with connecting means 53.

Figure 16:
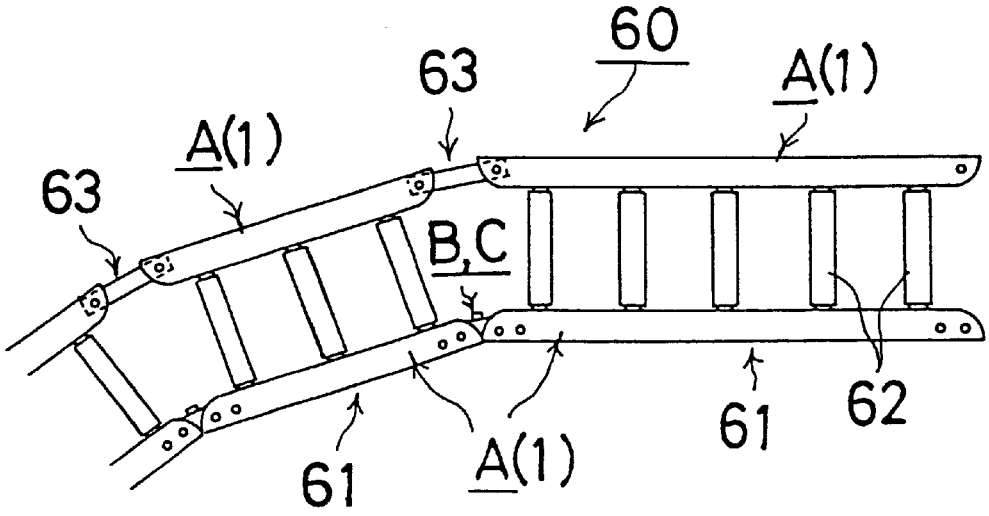
FIG. 16 shows a conveyor-line system 60 that can be constructed by use of link members similar to those used in FIG. 1.

Also, a conveyor-line system 60 of FIG. 16 can be provided according to the invention. It should be noted, however, that the system 60 employs link members A(1) different from the link member A of FIG. 1 in that each link member A(1) is a trough-shaped bar with an inner open side. Rollers 62 are received at their ends into the open sides of the opposed link members A(1) and, thus, the opposed link members A(1) and the rollers 62 constitute a conveyor unit 61. The link members A(1) located on one side are connected together similarly to the link members A of FIG. 1, that is, by use of the joint unit B and engaging member C, while the link members A(1) on the opposed side are joined together by using a connecting rod 63 longer than the joint unit B.

What is claimed is:

1. An elongated, curved framework with a variable degree of curvature which comprises (i) plural link members each having lower openings and a sloping shoulder at each end portion thereof, (ii) joint units connecting said link members together, each of the joint units having an upper opening and also having a pair of opposed openings at each end portion thereof, the joint unit also being so cut away at its lower portion as to form semicircular edges, (iii) a bolt-engaging member disposed inside the joint unit, the bolt-engaging member including an inverted-U shaped base and a nut, the inverted-U shaped base having an upper opening and also having a pair of opposed openings at each end portion thereof, the nut being fixed to a top of the inverted-U shaped base in a position coaxial with said upper opening, (iv) a bolt inserted through the upper opening of the joint unit and the nut and hence connecting the joint unit and the bolt-engaging member together, the bolt and the bolt-engaging member forming an element for bending the link members at the joint, (v) a first pivotal pin inserted through one of said lower openings of the link member and through one of said opposed openings of the joint unit for connecting the link member and the joint unit together, (vi) a second pivotal pin inserted through one of said lower openings of the link member and through one of said opposed openings of the bolt-engaging member thus connecting the link member and the bolt-engaging member together, and (vii) one retaining piece engaged with a circular groove formed in one end portion of each of the pivotal pins for preventing the pivotal pin being removed from the link member.

2. An elongated, curved framework of claim 1 further including (a) first, elongated openings formed in each end portion of each said link member, and (b) second, elongated openings formed on each side of the joint unit, these first and second elongated openings being located in corresponding positions but making an angle of some 45 degrees with each other when the adjacent link members are in alignment with each other, and (c) a third pivotal pin inserted through these first and second elongated openings and held on by a retaining piece.

* * * * *